United States Patent [19]

Skinner

[11] 3,951,402

[45] Apr. 20, 1976

[54] PAPER CONVEYOR AND GUIDANCE SYSTEM

[76] Inventor: Lloyd D. Skinner, 1150 NW. 79th St., Oklahoma City, Okla. 73112

[22] Filed: Mar. 25, 1974

[21] Appl. No.: 454,439

[52] U.S. Cl. ..... 271/273; 271/275

[51] Int. Cl.[2] ..... B65H 5/36

[58] Field of Search... 271/272–275, 264, 277, 229, 271/230, 236–238, 243–252

[56] References Cited

UNITED STATES PATENTS

| | | | |
|---|---|---|---|
| 1,973,749 | 9/1934 | Dawson | 271/251 |
| 2,135,206 | 11/1938 | Backhouse | 271/230 |
| 2,730,361 | 1/1956 | Kerr | 271/273 |
| 3,604,316 | 9/1971 | Labombarde | 271/264 |
| 3,741,536 | 6/1973 | Anderson | 271/274 |

*Primary Examiner*—Evon C. Blunk
*Assistant Examiner*—Jeffrey V. Nase
*Attorney, Agent, or Firm*—Laney, Dougherty, Hessin & Fish

[57] ABSTRACT

A paper conveyance and guidance system which includes a plurality of paper supporting endless conveyor bands for supporting and conveying a sheet of paper into abutting and properly registering contact with the head stop of a duplicator or printing press, and an elongated, slotted guide rack positioned over at least two of the bands, and each having an elongated slot therethrough with cylindrical apertures which extend through the respective rack spaced longitudinally along the respective slot. Spherical weights are rollably positioned in certain of the cylindrical apertures, and a register wheel is adjustably mounted in the elongated slot in each rack for selective positioning along the length thereof.

17 Claims, 5 Drawing Figures

PAPER CONVEYOR AND GUIDANCE SYSTEM

BACKGROUND OF THE INVENTION

1. Field of the Invention

This invention relates to apparatus for concurrently moving and guiding sheets of paper into a desired, pre-determined position in a duplicator or printing press. More particularly, but not by way of limitation, the invention relates to apparatus for improving the guiding and registering functions of the conveyance mechanism used on conveyor boards employed in offset duplicators.

2. Brief Description of the Prior Art

Duplicating machines and printing presses frequently include, in association with belt conveyors for moving sheets of paper into and through the machine, some type of structure for retaining the individual sheets in a desired path of movement as the sheets approach and contact the register stops. This structure is intended to prevent rebounding of the paper sheet from the stop after contact therewith, and to prevent buckling or bulging of the paper in a way which interferes with subsequent printing. The structures which have previously been utilized for this purpose have included spheres or balls carried in slots or recesses in bars positioned in the press or duplicator to allow contact and rolling movement of the ball upon the paper as it is driven into the head stop by the belt conveyors. Rollers mounted for rotation about horizontal axes in positions for tangentially contacting the surface of the paper sheets have also been used.

A recent ball-type guidance and registration system utilized for guiding and weighting paper being fed to the head stop or register stop is that shown in U.S. Pat. No. 3,741,536 to Anderson. In the Anderson structure, a register bar is provided above the paper supporting portion of the conveyor system, and the register bar is provided with a plurality of slots or races for the accommodation of a plurality of free-moving balls or spheres having peripheral portions projecting from the lower side of the register bar for rolling contact with sheets of paper carried on the conveyor. One or several of the register bars may be utilized, and are each slidably and adjustably positioned on an elongated support bar or rod for adjustment to selected positions along the path of travel of the paper sheets to be contacted by the balls. The number of the register bars used, and their positions along the supporting bar will be determined by the length of the paper stock being fed into the press or duplicator, and the points of pressure which are desired on the upper surface of each sheet of the paper as it moves on the conveyor. The register bars provided are mounted on their elongated supporting bars so that they may be adjusted axially therealong to desired positions in terms of their distance from the head stop. The register bars can also be adjusted vertically toward and away from their supporting bars so as to adjust the spacing between the periphery of the several balls, and the upper surface of the conveyor upon which the paper sheets are carried.

In the Anderson device, the balls or spheres are free-floating and thus can never impose any greater pressure or force upon the upper surface of the paper sheet than the weight of the balls. Further, the several balls carried in any one of the register bars act collectively and are evenly spaced with respect to the surface of the conveyor so that selective or independent adjustment of each ball's location cannot be attained. The Anderson structure further permits table whipping by the paper sheets in a way which is characteristic of all ball type guidance structures, since the balls are free to roll or turn in substantially any direction, and any spurious forces which tend to cause the paper sheets to cant or move sideways can do so without significant frictional resistance by the balls in contact therewith.

BRIEF DESCRIPTION OF THE PRESENT INVENTION

The present invention is an improved paper conveyance and guidance system for use in feeding or conveying successive sheets of paper against the head stop of a duplicator or printing press, and to attain exact registration of each sheet with the head stop. Broadly described, the invention comprises a conveyor for supporting the sheets, and an elongated, slotted rack assembly positioned over the conveyor and extending substantially parallel thereto. The elongated slotted rack assembly includes at least one elongated rack having a longitudinally extending slot formed therethrough, and further having a plurality of generally cylindrical apertures which extend through the rack at the locus of the slot, and which are spaced longitudinally from each other along the slot. One or more balls or spherical members are positioned in the several cylindrical apertures. At least one wheel or disc is adjustably mounted on the rack and extends through the slot therein for tangential rolling contact with paper sheets carried on the conveyor.

In a preferred embodiment of the invention, a plurality of the ball and wheel carrying racks are provided, and each is positioned above an endless belt constituting a part of the conveyor. A preferred embodiment of the invention also includes chamfers or bevels formed at the intersection of at least one of the cylindrical apertures with the side of the longitudinally extending slot in the rack which is nearest the conveyor.

The described structural arrangement permits the inherent advantages of both ball and wheel guidance and weighting to be obtained through a relatively simple, yet mechanically sturdy mechanism which is characterized in having a long and trouble-free operating life.

An important object of the invention is to provide a paper guidance and conveyance system for moving sheets of paper into contact with the head stop of a duplicator or printing press in a way which reduces or eliminates table whipping of the sheets of paper.

A further object of the invention is to provide a guidance mechansim for guiding sheets of paper through a pre-determined true path of travel into squarely abutting, precisely registering relation to the head stop of a duplicator or printing press.

An additional object of the invention is to provide a paper guidance and conveyance system in which the weight applied to the upper side of the paper sheets to retain them in contact with the upper side of a conveyor can be selectively adjusted.

A further object of the invention is to provide a paper sheet guidance and conveyance system for introducing, in sequence, individual sheets of paper into a printing press or duplicator, which system allows the weight or paper being fed to be varied by offering adjustability of the pressures applied by elements of the system to the upper side of each sheet, and by the selective location of pressure points therealong.

A further important object of a preferred embodiment of the invention is to provide a ball braking arrangement by which buckled or damaged sheets of paper may be prevented from passing along the conveyor provided in duplicators and printing presses for sequentially conveying sheets of paper into contact with the head stop of such apparatus.

Another object of the invention is to provide a ball braking arrangement, functioning in conjunction with the sheet feeding mechanism of duplicators and printing presses, to automatically arrest feeding of buckled, damaged or anomalous paper sheets, and all subsequent following sheets, to the duplicator or printing press, and thereby avoid jamming, including of poor quality sheets in the printed product stock, damage to the sheet delivery mechanism and other presently encountered deleterious results and effects attributable to the absence of an effective sheet arresting mechanism.

A further object of the invention is to provide a paper guidance and conveyance system for conveying sheets of paper into a printing press or duplicator in such a way that the service life of the printing blanket is extended, or at least is not deleteriously affected, as a result of mashing or distortion due to damaged or spurious sheets of paper being placed in contact therewith.

Additional objects and advantages of the invention will become apparent from the following detailed description of a preferred embodiment of the invention as the same is considered in conjunction with the accompanying drawings which illustrate the invention.

DETAILED DESCRIPTION OF A PREFERRED EMBODIMENT OF THE INVENTION

Figure 1:
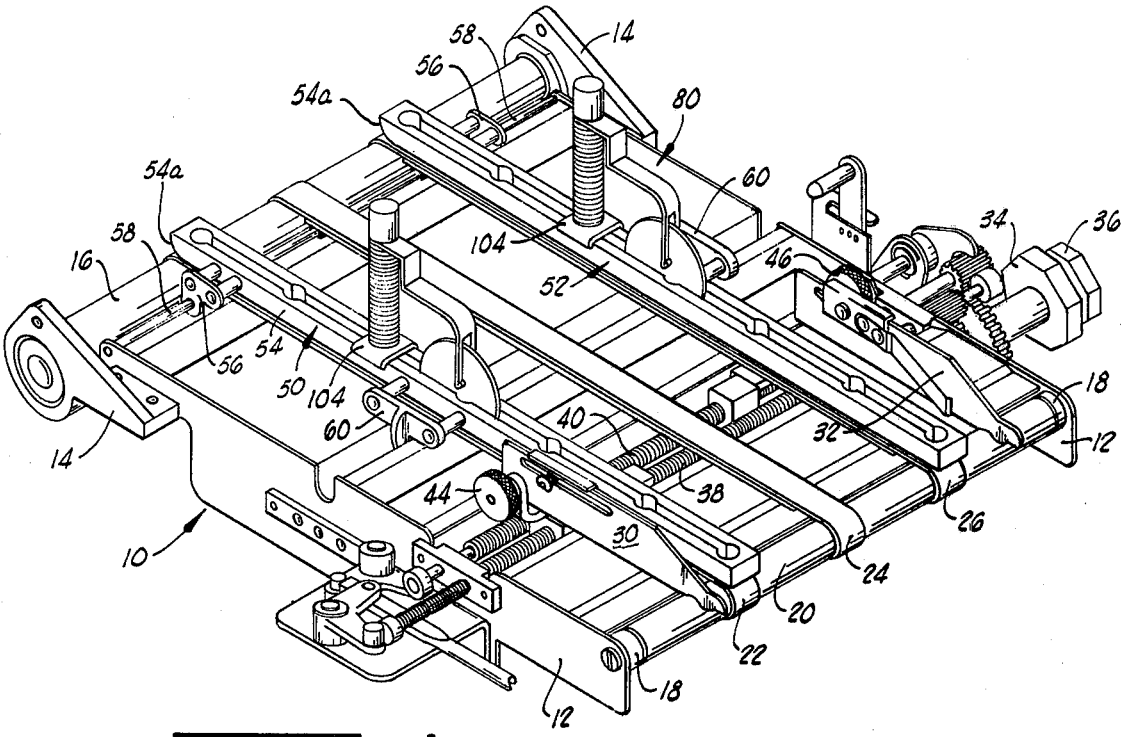
FIG. 1 is a perspective view illustrating the conveyor board portion of an offset duplicator having the paper guidance and conveyance system of the present invention incorporated therein.

Referring initially to FIG. 1 of the drawings, a conveyor board of the type used in an offset duplicator is shown therein, and includes a framework designated generally by reference numeral 10. The framework 10 includes a pair of opposed, substantially parallel frame side plates 12. The frame side plates 12 are inclined slightly to the horizontal, and at the higher end thereof, are secured to a pair of roller supporting brackets 14. The roller supporting brackets 14 journal a conveyor drive roller 16 which extends substantially horizontally and transversely across the conveyor board. At their lower forward ends, the frame plates 12 mount journal blocks 18 which rotatably support an elongated idler roller 20.

Extending around the drive roller 16 and the idler roller 20 are a plurality of endless belts. In the illustrated embodiment of the invention, three of the belts are provided, and are designated by reference numerals 22, 24 and 26. The belts 22, 24 and 26 function to support and convey successively fed sheets of paper against a head stop located adjacent, but in spaced relation to, the idler roller 20 in a manner hereinafter described. Positioned adjacent the two outer belts 22 and 26 are a pair of side guide plates 30 and 32. The side guide plates 30 and 32 extend from tapered ends which project over the idler roller 20, to two locations which are spaced from the idler roller in the direction of the drive roller 16.

In the type of conveyor board structure illustrated, the side guide plates 30 and 32 can be individually adjusted from a single location at one side of the duplicator in which the conveyor board is mounted by means of the dual adjustment knobs 34 and 36. The dual adjustment knobs 34 and 36 function to adjust the side guide plates 30 and 32 through elongated screw shafts 38 and 40 in a conventional manner. Fine adjustments of the side guide plates 30 and 32 can be obtained by means of the fine adjustment knobs 44 and 46.

Figure 5:
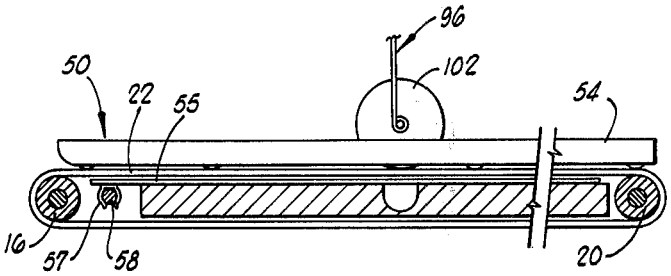
FIG. 5 is a longitudinal sectional view through the conveyor board and paper guidance and conveyance system of the present invention, illustrating the position of one of the belt supporting straps used in some embodiments of the invention.

Mounted above the endless belts 22 and 26 are a pair of slotted rack assemblies designated generally be reference numerals 50 and 52. Each rack assembly, in the illustrated embodiment, is identically constructed and includes an elongated rack 54. The rack assemblies 50 and 52 are mounted with the racks 54 thereof positioned above, and extending parallel to, the endless conveyor belts 22 and 26, with the respective racks being supported in the framework by means of a pair of rear supporting brackets 56 mounted on a shaft 58 secured to the side plates 12 of the framework, and by a pair of brackets 60 which are mounted on a threaded shaft (not seen) so that they can be moved inwardly or outwardly for lateral adjustment of the racks 54. In the illustrated embodiment of the invention, relatively rigid, elongated straps 55 are provided and located beneath each of the belts 22, 24 and 26 and over the upper side of the conveyor board. Each strap 55 is of substantially the same width as the belt which it underlies, and is retained in the described position by a spring clip 57 secured to one end portion thereof, and detachably engaging the shaft 58 as shown in FIG. 5.

Figure 2:
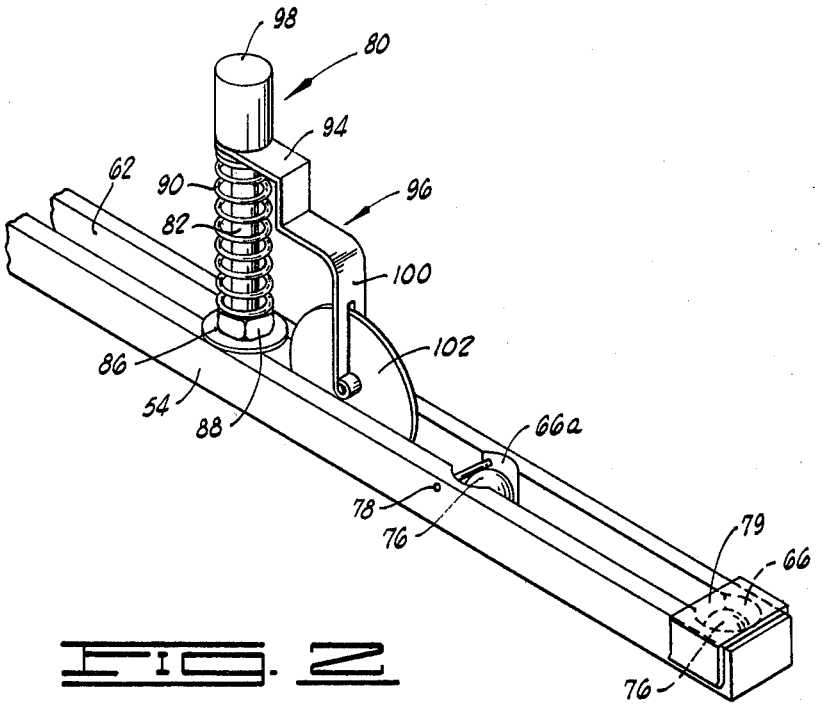
FIG. 2 is a perspective view of one of the elongated, slotted guide racks and associated spheres and rollers forming a portion of the present invention.
Figure 3:
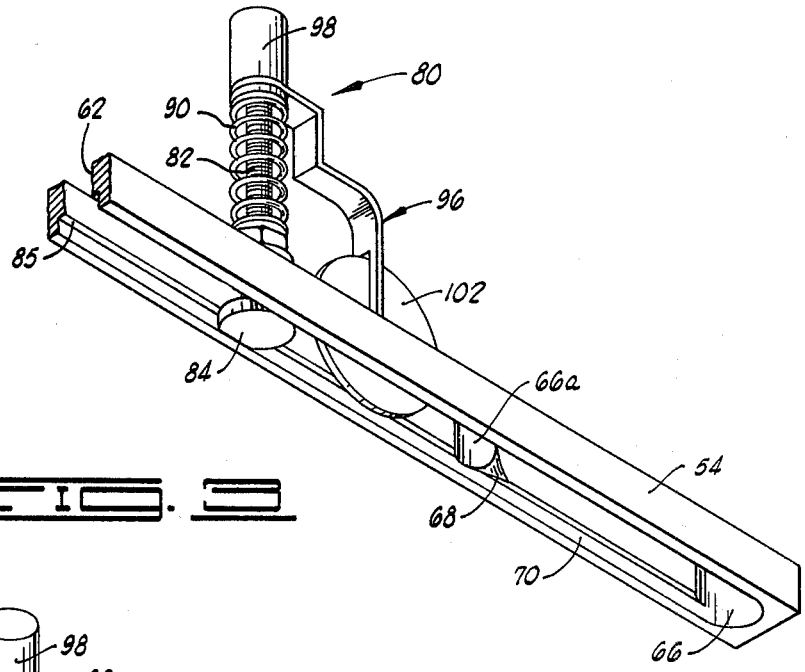
FIG. 3 is a perspective view illustrating a part of one of the guide racks shown in FIG. 2, but having the spheres or balls removed therefrom and showing the guide rack and associated roller as they appear when viewed from the lower side thereof.
Figure 4:
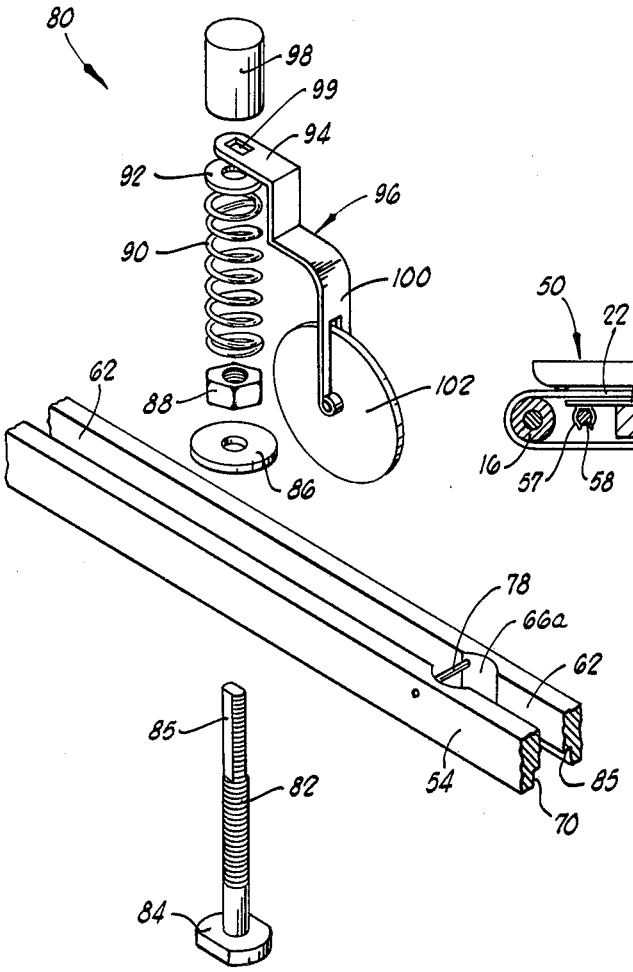
FIG. 4 is an exploded view showing the several structural elements depicted in FIG. 2.

The details of construction of each of the rack assemblies 50 and 52 are best illustrated in FIGs. 2–4. As shown in FIG. 2, the rack 54 of each of the rack assemblies is an elongated rigid bar which has a longitudinally extending slot 62 formed therein and extending over a major portion of the length of the rack. It will be noted in referring to FIG. 1 that one end of each of the racks 54, which may be referred to as the upstream or rear end, is beveled upwardly, as shown at the points indicated by reference numerals **54*a*, so that sheets of paper may be easily fed between the racks and the underlying endless belts 22 and 26**.

Each of the racks 54 is further characterized in having a plurality of generally cylindrical apertures or openings 66 formed through the rack at spaced locations along the slot 62. The cylindrical apertures 66 extend from the top of the rack to the bottom side thereof, and it will be noted in referring to FIG. 3 that the particular cylindrical aperture **66*a* which is the second aperture from the forwardmost aperture through the rack 54 is provided with chamfers 68 at the leading or forward side of the locus of its intersection with the lower side of the slot 62. The purpose of these chamfers or bevels 68 at this location will be subsequently explained. In referring to FIG. 3 of the drawings which shows the lower side of one of the racks 54, it will be noted that a relatively wider longitudinally extending slot 70 is provided in the bottom side of the rack 54 and intersects the slot 62. It is at the point of intersection of the relatively wide slot 70 with the slot 56 and the cylindrical aperture 66***a* that the bevels or chamfers are formed.

Positioned in one or more of the cylindrical apertures 66 spaced longitudinally along the rack 54 are spherical members or balls 76. It will be noted that in the case of the balls 76 which are located in the second cylindrical apertures 66*a*, these balls are limited in their upward movement by a pin 78 which is extended across the aperture in which this ball is located, and which is positioned slightly to the rear of the central axis of the aperture. The other spheres or balls 76 are free-floating in the sense that they attain a position in the lower end of the respective cylindrical aperture 66 in which they are located only by reason of gravity. In one embodiment of the invention, however, U-shaped spring clips 79 can be snapped over the apertures 66 by detachable engagement with the rack 54, as illustrated in FIG. 2.

Each of the rack assemblies 50 further includes one or more disc subassemblies 80. Two embodiments of disc subassembly 80 are illustrated in the accompanying drawings. The disc subassembly 80 illustrated in FIG. 3 includes an elongated, vertically extending bolt 82 which is threaded over a major portion of its length, and which carries a head 84. The bolt head 84 is configured to fit within the slot 70 in the lower side of the rack 54, and to bear against a shoulder 85 formed at the intersection of this slot with the slot 62. Due to the size and configuration of the head 84, the threaded bolt 82 is prevented from rotating about its axis within the slots 70 and 62. The threaded upper end portion of the shaft of each bolt 82 is flatted on opposite sides thereof, as indicated by reference numeral 85, with these flats extending parallel to the flat sides of the bolt head 84.

In the embodiment of the invention illustrated in FIGS. 2–4, a washer 86 is passed over the shank of the bolt 82 and bears against the upper side of the rack 54. A nut 88 can be threaded down on the shank of the bolt 82 into contact with the washer 86 to firmly retain the bolt 82 in the rack 54 with the threaded end portion of the shank projecting upwardly from the rack. Above the nut 88, a helical compression spring 90 is provided around the bolt shank 82, and it is possible to omit the nut 88 from the disc assembly 80, and rely only upon the force of the spring 90 to seat the bolt head 84 in the slot 70. The upper end of the helical compression spring 90 bears against a washer 92, and an end portion 94 of a spring metal disc supporting arm, designated generally by reference numeral 96, is positioned between the washer 92 and an internally threaded adjusting cap 98. The end portion 94 of the arm 96 carries a straight sided slot 99 to key the arm to the bolt 82 and prevent rotation of the arm on the bolt. The slot 99, of course, registers with the flats 85 on the bolt. It will be perceived in referring to the drawings that the disc supporting arm 96 is angulated or bent through three substantially 90° bends, and has a bifurcated lower end portion 100 which receives a pressure disc or wheel 102 journaled by any suitable means between the legs of the bifurcated end portion of the disc supporting arm. The pressure disc 102 is mounted for rotation about a horizontal axis and in a vertical plane, and it will be perceived in referring to FIG. 3 of the drawings that the lowermost extremity of the pressure disc 102 protrudes slightly below the lower side of the rack 54.

When each disc subassembly 80 is assembled in its operative position, the bolt 82 can be secured firmly at a selected position along the slot 62 in the rack 54 by tightening the nut 88 down upon the washer 86 to draw the head 84 into abutting contact with the shoulder 85. The specific position of the pressure disc 102 in relation to the rack 54 and the respective underlying endless belt 22 or 26 is adjusted by threading the adjusting cap 98 down upon the threaded upper end of the bolt 82 a selected distance. In this way, the pressure exerted by the pressure disc 102 upon a sheet of paper passing thereunder can be selectively adjusted.

It should be pointed out that a useful variation in structure (and, in fact, a preferred embodiment of the invention) which can be employed in the construction of the disc subassembly 80 is that which is illustrated in FIG. 1 where a generally U-shaped saddle 104 has been used to replace the washer 86 and the nut 88 in the embodiment of the invention illustrated in FIGS. 2–4. The saddle 104 spans across and engages the upper side of the rack 54 and forms an abutment against which the lower end of the compression spring 90 bears in the embodiment of the invention illustrated in FIG. 1. The saddle 104 functions to prevent spreading of the sides of the rack 54 to undesirably enlarge the slot 62, and in this function cooperates with the bolt bead 84 which prevents convergence of the sides of the rack resulting in undesirable narrowing of the slot.

It should further be pointed out that in another embodiment of the invention, sometimes useful in more effectively accomplishing the conveying and guiding functions of the present invention, a pair of the disc assemblies 80 may be positioned along a single one of the slots 62 with the disc supporting arms 96 thereof projecting from their respective bolts 82 the same or opposite direction, so that one of the pressure discs 102 is in alignment with, and occupies the same vertical plane as the other of the two pressure discs.

OPERATION OF THE PAPER CONVEYANCE AND GUIDANCE SYSTEM OF THE INVENTION

In the use of the paper conveyance and guidance system of the invention, sheets of paper are fed in sequence to the conveyor board by insertion of the leading edge of the leading sheet between the tapered surfaces 54*a* of the racks 54 and the underlying endless belts 22 and 26. The paper is then conveyed on the upper surface of the belts 22 and 26 toward a heat stop (not shown) located at the forward or leading end of the conveyor board. As the paper sheets move down the endless belts 22 and 26 under the rack assemblies 50, the upper surfaces of the sheets are contacted by the balls 76 and by the lower peripheral edges of the pressure discs 102. During the conveyance of the sheets through the assembly on the conveyor board, they are prevented from buckling by the weight exerted by the pressure discs 102. In this regard, it should be pointed out that the pressure which is exerted on the moving paper by the pressure discs can be adjusted by adjustment of the position of the adjusting caps 98 on the threaded shanks of the bolts 82. Further, the spacing between the balls 76 can be selectively varied, and the pressure discs 102 carried in the disc subassemblies 80 can be positioned at any selected location along the racks 54. This adjustability and selectivity of pressures and contact points by the balls and by the pressure discs 102 allows paper stock of varying weight (heavy or light) to be conveyed, without malfunction, to the head stop. In some duplicators, such as those of the type shown in the drawings, depressions or troughs extend transversely across the upper side of the conveyor board for the accommodation of shafting and control mechanism. The purpose of the straps 55 is to support the belts 22, 24 and 26 where they cross these troughs at times when the pressure discs 102 are disposed thereabove.

As each individual sheet of paper approaches the forward or leading end of the conveyor board, it will generally be desirable to provide several of the balls 76 in contact with the upper surface thereof. The pressure discs 102 are pre-adjusted in their longitudinal positions along the racks 54 so that the outer peripheral surface of each pressure disc 102 makes contact with the trailing edge of each sheet of paper at the instant that the leading edge of the sheet comes in contact with the head stop positioned just ahead of the conveyor board. The pressure discs thus exert a biasing effect which prevents bouncing or recoil displacement of the sheets away from the head stop, which condition, if allowed to occur, will cause difficulties or malfunction in the later course of lateral or sideways movement of the paper sheets affected as one of the guide plates 30 or 32 is used to move the sheets sequentially onto the duplicating drums of the duplicator or printing press. It is also pointed out that the inability of the pressure disc 102 to pivot or cant about a vertical axis allows them to frictionally resist any sideways or lateral movement of the paper sheets moving down the endless belts 22 and 26 of the conveyor board. Thus, table whipping of the sheets, which is possible where only balls or spherical members are used, is obviated and a truer travel of the sheets of paper toward the head stop of the press or duplicator is attained.

The function of the chamfers or bevels 68 provided at the lower end of the cylindrical apertures 66*a* is to cause the balls 76 located in these particular apertures to encounter enhanced or increased frictional resistance to free-rolling movement at a time when the ball is lifted up into contact with the chamfers or bevels as a result of riding over a sheet which has a wrinkle or crease therein, or which is otherwise of anomalous condition with respect to the other sheets being run. The result of this contact of the ball surface with the chamfers to tapers 68 is to brake the turning movement of the ball, or place a drag thereon, thus terminating the ability of the ball to roll freely on the upper surface of the paper, and accordingly braking or interrupting the movement of the paper sheets toward the head stop. The sheet feeding mechanism of the machine then is automatically shut down with the result that the bad sheets which have come in contact with the balls located in the cylindrical apertures 66*a* are not fed into the printing mechanism, nor are additional sheets subsequently fed to the machine until the defective or anomalous sheets have been cleared. This feature of the invention prevents a number of undesirable end effects from occurring, including, but not limited to, the passage of bad sheets into the ink rollers, damage to the delivery mechanism of the duplicator, destruction of, or damage to, the printing blanket, and inclusion of bad or defective copies among the product copies, resulting in customer dissatisfaction.

From the foregoing description of the invention, it will be perceived that the novel paper conveyance and guiding system of the invention affords much better registration of individual sheets to be printed with the head stop of the duplicating or printing apparatus, and improves the overall performance of the equipment. It also enables a better quality product to be attained in that fewer poor or defective copies are included in the output of the apparatus.

Although certain preferred embodiments of the invention have been herein described, it will be understood that various changes and innovations in the illustrated and described structures can be effected without departure from the basic principles of the invention. Changes and innovations of this type are therefore deemed to be circumscribed by the spirit and scope of the invention, except as the same may be necessarily limited by the appended claims or reasonable equivalents thereof.

What is claimed is:

1. A paper conveyor and guidance system comprising:
   - a conveyor for conveying sheets of paper in a flat, upwardly facing status;
   - an elongated, slotted rack assembly positioned over the conveyor and extending substantially parallel thereto, said rack assembly comprising:
   - at least one elongated rack having a longitudinally extending slot formed therethrough, and further having at least one generally cylindrical aperture extending through the rack at the locus of the longitudinally extending slot and intersected thereby;
   - balls positioned in one or more of the generally cylindrical apertures and positioned for rolling contact with paper passed between said conveyor and rack; and
   - a disc subassembly adjustably mounted on said elongated rack for selective positioning along the length thereof, said disc subassembly including:
   - a pressure disc mounted for rotation about a horizontal axis and having a peripheral portion projecting below said rack toward said conveyor; and
   - means mounting said pressure disc on said rack for selectively adjusting the extent to which said peripheral portion projects below said rack.

2. A paper conveyor and guidance system as defined in claim 1 and further characterized as including spring means resiliently connecting said disc to said mounting means and resiliently resisting upward movement of said disc.

3. A paper conveyor and guidance system as defined in claim 2 wherein said spring means is a bifurcated spring metal arm having said pressure disc mounted therein.

4. A paper conveyor and guidance system as defined in claim 1 wherein said conveyor comprises;
   - a pair of spaced, endless belts extending substantially parallel to each other; and
   - wherein said rack assembly comprises a pair of elongated racks, each positioned over, and extending substantially parallel to, one of said belts.

5. A paper conveyor and guidance system as defined in claim 4 and further characterized as including straps mounted directly under the upper run of said belts and supporting the belts against downward pressure exerted thereon.

6. A paper conveyor and guidance system as defined in claim 1 wherein said conveyor and rack assembly are inclined to the horizontal, and said rack has a beveled surface at one end thereof for guiding paper sheets between the rack and said conveyor.

7. A paper conveyor and guidance system as defined in claim 1 wherein said disc subassembly is further characterized as including:

a bifurcated, spring metal disc supporting arm receiving and journaling said pressure disc in the bifurcation thereof, and having an end portion spaced from said disc; and a bolt projecting through, and axially slidable in, said slot, and having the end portion of said arm connected thereto.

8. A paper conveyor and guidance system as defined in claim 1 wherein said conveyor and guidance system includes a plurality of said racks, and each of said racks has a plurality of said generally cylindrical apertures formed therethrough, and at least one of these cylindrical apertures in each rack has chamfered surfaces at the lower end thereof; and wherein one of said balls is positioned in at least one of said apertures having said chamfered surfaces.

9. A paper conveyor and guidance system as defined in claim 1 and further characterized as including spring clips detachably engaged with said rack at a location over at least one of the ball-containing apertures.

10. A paper conveyor and guidance system as defined in claim 1 wherein said means mounting said pressure disc on said rack comprises:

a bolt projecting through said longitudinally extending slot and having a threaded upper end spaced above said rack;

an arm rotatably supporting said disc and having one end movably connected to said bolt for axial movement along the shank of said bolt above said rack;

a spring positioned around said bolt between said arm and said rack; and an adjusting cap threaded on the upper end of said arm and selectively positionable thereon to force said arm toward said rack against the bias of said spring.

11. A paper conveyor and guidance system as defined in claim 10 wherein said bolt has flat sides formed thereon, and the end of said arm connected to said bolt is slotted, with the slot therein registering with the flat sides of said bolt to prevent rotation of the arm on the bolt and maintain the pressure disc carried by the arm centered in the longitudinally extending slot in the rack.

12. A paper conveyor and guidance system as defined in claim 10 wherein said paper and guidance system includes a plurality of said racks, and each of said racks is further characterized in having a second longitudinally extending slot therein on the opposite side of said rack from said first mentioned slot, and wherein said bolt has a head positioned in said second slot and preventing narrowing of said slots upon application of compressive forces to opposite sides of said rack.

13. A paper conveyor and guidance system as defined in claim 12 and further characterized in having a saddle bridging said first mentioned slot and engaging the opposite sides of said rack to prevent spreading of said rack to enlarge said first mentioned slot, said saddle having said bolt projecting through the center thereof.

14. A paper conveyor and guidance system as defined in claim 3 wherein said arm is bifurcated and is of spring metal construction and has said pressure disc mounted in the bifurcation thereof.

15. A paper conveyor and guidance system as defined in claim 14 wherein said conveyor and guidance system includes a plurality of said racks, and wherein each of said racks has a plurality of said generally cylindrical apertures formed therethrough, and at least one of these cylindrical apertures in each rack has chamfered surfaces at the lower end thereof; and wherein one of said balls is positioned in at least one of said apertures having said chamfered surfaces.

16. A paper conveyor and guidance system comprising:

a conveyor for conveying sheets of paper in a flat, upwardly facing status;

an elongated, rack assembly positioned over the conveyor and extending substantially parallel thereto, said rack assembly comprising:

at least one elongated rack having at least one generally cylindrical aperture extending through the rack above the conveyor and in a direction substantially normal to the conveyor surface and to sheets of paper conveyed thereon;

balls positioned in one or more of the generally cylindrical apertures and positioned for rolling contact with paper passed between said conveyor and rack; and a disc subassembly adjustably mounted on said elongated rack for selective positioning along the length thereof, said disc subassembly including:

a pressure disc mounted for rotation about a horizontal axis and having a peripheral portion projecting below said rack toward said conveyor; and means mounting said pressure disc on said rack for selectively adjusting the extent to which said peripheral portion projects below said rack.

17. A paper conveyor and guidance system comprising:

a conveyor including at least two endless belts having substantially coplanar upper runs for supporting upwardly facing sheets of paper in a flat, upwardly facing status;

an elongated rack assembly positioned over said conveyor and extending substantially parallel thereto, said rack assembly comprising:

at least one elongated rack having at least one generally cylindrical aperture extending through the rack and projecting substantially normal to the plane of the upper surface of said endless belts, and to a sheet of paper conveyed on said belts in a flat, upwardly facing status, one of said generally cylindrical apertures terminating at its lower end in a chamfered surface inclined with respect to the axis of said generally cylindrical aperture and inclined at an angle to the plane of the upper surface of said two endless belts and the surface of a sheet of paper conveyed on said belts in a flat, upwardly facing status, said chamfered surface sloping downwardly and outwardly away from said one cylidrical aperture;

a ball positioned in said generally cylindrical aperture terminating in said chamfered surface and supported in said aperture for free rolling contact with the upper surface of the flat, smooth sheets of paper conveyed on the upper run of said belts, said ball being smaller in diameter than the diameter of the cylindrical aperture at any location in the aperture; and a pressure disc adjustably mounted on said rack over said conveyor at a predetermined location therealong to contact the rear edge of a sheet of paper supported by, and conveyed on, said belts when said sheet reaches a predetermined position on said belts while said sheet is under, and contacted by, said ball, said pressure disc being manually adjustable along the length of said elongated rack to selectively change the spacing between said pressure disc and said ball, and said pressure disc being manually adjustable in a direction extending normal to the longitudinal axis of said elongated rack to permit the peripheral portion of said pressure disc to be moved closer to, or farther from, a sheet of paper conveyed on said belt.

* * * * *

UNITED STATES PATENT OFFICE
CERTIFICATE OF CORRECTION

Patent No. 3,951,402 Dated April 20, 1976

Inventor(s) Lloyd D. Skinner

It is certified that error appears in the above-identified patent and that said Letters Patent are hereby corrected as shown below:

Column 2, line 64, change "or" to --of--;

Column 4, line 27, change "be" to --by--;

Column 7, line 52, change the first "to" to --or--;

Column 10, line 2, change "3" to --10--.

Signed and Sealed this

Sixth Day of July 1976

[SEAL]

*Attest:*

RUTH C. MASON
*Attesting Officer*

C. MARSHALL DANN
*Commissioner of Patents and Trademarks*